US005336341A

United States Patent [19]

Maejima et al.

[11] Patent Number: 5,336,341

[45] Date of Patent: Aug. 9, 1994

[54] INFRARED RADIATION ELEMENT AND PROCESS OF PRODUCING THE SAME

[75] Inventors: Masatsugu Maejima, Tokyo; Koichi Saruwatari, Musashino; Akihito Kurosaka, Tokyo; Mamoru Matsuo, Fukaya; Hiroyoshi Gunji, Tsuchiura; Toshiki Muramatsu, Fukaya, all of Japan

[73] Assignees: Fujikura Ltd.; Sky Aluminium Co., Ltd., both of Tokyo, Japan

[21] Appl. No.: 753,098

[22] Filed: Aug. 30, 1991

[30] Foreign Application Priority Data

Aug. 30, 1990 [JP] Japan ..... 2-228971

[51] Int. Cl.[5] ..... C22C 21/00

[52] U.S. Cl. ..... 148/415; 148/549; 148/698; 148/702; 205/106; 205/109; 205/207; 420/547; 420/550; 428/632; 428/640

[58] Field of Search ..... 148/415, 549, 698, 702, 148/632, 640; 205/106, 109, 207; 420/547, 550

[56] References Cited

U.S. PATENT DOCUMENTS 4,483,750 11/1984 Powers et al. ..... 205/206
4,915,798 4/1990 Maitland ..... 205/207

FOREIGN PATENT DOCUMENTS 51-21534 2/1976 Japan ..... 428/632
63-145797 6/1988 Japan .

*Primary Examiner*—Richard O. Dean
*Assistant Examiner*—Robert R. Koehler
*Attorney, Agent, or Firm*—Cushman, Darby & Cushman

[57] ABSTRACT

An infrared radiation element and a process for producing the same. An aluminum alloy material consists essentially of 0.3 to 4.3 weight % of Mn, balance Al, and impurities. The alluminum alloy material is heated for dispersing a precipitate of an Al—Mn intermetallic compound at a density of at a minimum $1\times10^5/mm^3$ for a size of 0.1 μm to 3 μm. The heated aluminum alloy material is anodized to form an anodic oxide layer thereon.

17 Claims, 2 Drawing Sheets

INFRARED RADIATION ELEMENT AND PROCESS OF PRODUCING THE SAME

The present invention relates to an infrared radiation element and a process of producing the same. The infrared radiation element is capable of effectively emitting infrared radiation and extreme infrared radiation in various treatments, such as heating and cooking, making use of radiation heat.

In the heater or the like appliance utilizing infrared radiation, the radiator is required to be high in emissivity, small in emission In the visible region at relatively low surface temperatures above 100° C., and large in emission in infrared radiation region. Thus, radiators made of ceramics, which considerably meet such requirements are placed into market. The ceramics includes alumina, graphite and zirconia, for example.

It is known that among the ceramics alumina is superior in both extreme infrared radiation characteristic and heat resistance at high temperature to the other ceramics. In view of this point, various attempts have been made to utilize a high purity aluminum member, having an anodic oxide layer formed on one surface thereof by anodizing, as a radiation element superior in heat conductivity and far infrared radiation characteristic.

Conventional radiation elements anodized have however a problem in that the radiation elements ere limited in use since they are disadvantageous in the following points:

(1) The radiation elements produce cracks at 200° C. or higher, so that they become unstable in emissivity and deteriorate in corrosion resistance;

(2) The radiation elements are low in emissivity in a wavelength region of 3 to 7 μm; and (3) it is hard to form the radiation elements.

Among the problems above described, the problem (1) can be overcome by using an aluminum alloy which is hard to produce cracks at high temperatures of 200° C. or higher. However, such an aluminum alloy with an anodic oxide film which is hard to produce cracks is not yet known.

Regarding the problem (2) , it is known that emissivity 15 in infrared radiation region can be improved by coloring infrared radiation elements with a dyestuff. This technique adds an extra coloring step with a dyestuff, and furthermore is disadvantageous in that the radiation elements deteriorate in infrared radiation characteristic due to discoloring by decomposition of the coloring agent at high temperatures of 200° C. or higher.

To improve workability of the radiation elements to overcome the problem (3), it may be preferable to form the anodic oxide coating as thin as possible. However, in the case where the anodic oxide layer is sufficiently thin, the infrared radiation emissivity thereof deteriorates, and becomes unstable. Moreover, the anodic oxide layer is degraded in corrosion resistance.

Accordingly, it is an object of the present invention to provide a infrared radiation element which is hard to produce cracks in the aluminum layer due to thermal strains at high temperatures above about 200° C., and is excellent in both infrared radiation emissivity and workability.

According to one aspect of the present invention, there is provided an infrared radiation element comprising: an aluminum alloy material consisting essentially of about 0.3 to about 4.3 weight % of Mn, balance Al, and impurities; and an anodic oxide layer formed on a surface of the aluminum alloy material. The aluminum alloy material has a precipitate of an Al—Mn intermetallic compound dispersed at a density of about $1\times10_5/mm^5$ at a minimum for a site of about 0.01 μm to about 3 μm.

The infrared radiation element according to the present invention includes an aluminum alloy having a porous anodic oxide layer formed on one surface thereof, the aluminum alloy containing an Al—Mn intermetallic compound dispersed in it. The porous anodic oxide layer has a complicated branched structure of micropores which have grown in various directions so as to avoid crystallized portions of the intermetallic compound during forming thereof. This structure Causes the anodic oxide layer to perform a buffer action of stresses due to thermal strains in it. Furthermore, the anodic oxide layer becomes hard to produce cracks due to quenching from high temperatures, and has an excellent heat resistance against high temperatures above about 200° C.

The anodic oxide layer produced is low in lightness and has a color close to black. There is, hence, little drop In radiation characteristic in a wavelength region of 2 to 7 μm, and an infrared radiation element which has an excellent stable radiation characteristic is thus provided.

Furthermore, the base material of the alloy material on which the anodic oxide film is formed is an aluminum alloy, and this enables various kinds of processing, such as drawing, boring, bending, cutting, and local etching, to be conducted on the alloy material with ease for forming into a desired shape, and then an anodic oxide film is formed on the alloy material. It is thus possible to fabricate infrared radiation elements having a complicated shape which was impossible to form in conventional infrared radiation elements, and hence infrared radiation elements of the present invention has wide practical In another aspect of the present invention, the aluminum alloy contains Mg at an amount of about 0.05 to about 6% by weight in the first aspect of present invention previously described.

In a third aspect of present invention, there is provided a process of producing an infrared radiation element, comprising the steps of: (a) heating an aluminum alloy material consisting essentially of about 0.3 to about 4.3 weight % of Mn, balance Al, and impurities for dispersing a precipitate of an Al—Mn intermetallic compound at a density of at a minimum about $1\times10^5/mm^3$ for a size of about 0.01 μm to about 3 μm; and (b) anodizing the heated aluminum alloy material to form an anodic oxide layer thereon.

According to a fourth aspect of the present invention, there is provided a process of producing an infrared radiation element, comprising the steps of: casting a molten alloy at a cooling speed of at least about 5° C./sec to produce an aluminum alloy material, the molten alloy consisting essentially of: about 0.8 to about 3.5 weight % of Mn; balance Al; and impurities; heating the aluminum alloy material at about 300° to about 600° C. for at least about 0.5 hour for dispersing a precipitate of an Al—Mn intermetallic compound at a density of at a minimum about $1\times10_5/mm^3$ for a size of about 0.01 μm to about 3 μm; and anodizing the heated aluminum alloy material to form an anodic oxide layer thereon.

In a fifth aspect of the present invention, a process of producing an infrared radiation element comprises the steps of: casting a molten alloy at a cooling speed at least about 5° C./sec to produce an aluminum alloy material, the molten alloy consisting essentially of: about 0.8 to about 3.5 weight % of Mn; about 0.05 to about 2.0 weight % of Mg; balance Al; and impurities; heating the aluminum alloy material at about 300° to about 600° C. for at least about 0.5 hour for dispersing a precipitate of an Al—Mn intermetallic compound at a density of at a minimum about $1\times10^5/mm^3$ for a size of about 0.01 μm to about 3 μm; and anodizing the heated aluminum alloy material to form an anodic oxide layer thereon.

In a sixth aspect of the present invention, a process of producing an infrared radiation element comprises the steps of: die casting a molten alloy at a cooling speed of about 0.5° to about 20° C./sec to produce an aluminum alloy material, the molten alloy consisting essentially of: about 0.8 to about 1.5 weight % of Mn; about 2.0 to about 4.5 weight % of Mg; about 0.003 to about 0.15 weight % of Ti, as a grain refining agent, singly or in combination with about 1 to about 100 ppm of B; balance Al; and impurities; heating the aluminum alloy material at about 300° to about 600° C. for at least about 0.5 hour for dispersing a precipitate of an Al—Mn intermetallic compound at a density of about $1\times10^5/mm^3$ at a minimum for a size of about 0.01 μm to about 3 μm; and forming an anodic oxide layer on the heated aluminum alloy material.

According to the third to seventh aspect of the present invention, infrared radiation elements are positively produced in a mass production scale.

The infrared radiation element according to the present invention may be used in the following various uses: room heaters such as a stove; cooking heating appliances such as steak plate, receptacle for electronic cooking range, toaster, and food conveyer belt; aging equipment for whisky; and construction material such as curtain wall.

To produce an infrared radiation element according to the present invention, firstly an aluminum alloy having about 0.3 to about 4.3 weight % of Mn added to aluminum is produced. To obtain such an alloy an Al—Mn alloy in the form of a block or a powder may be added to a molten aluminum, and then the alloy is cast by a continuous casting machine, semi-continuous casting machine, for example.

When Mn is added beyond about 4.3 weight %, coarse Mn compounds are produced during casting, and these compounds make working, such as rolling, hard. Moreover, cracks are liable to be produced from the Mn compounds as starting points during forming of the anodic oxide film. Below about 0.3 weight % of Mn, a sufficient amount of precipitates of an Al—Mn intermetallic compound are not produced in a sufficiently dispersed state, and hence sufficiently branched anodic oxide film cannot be formed. Anodic oxide films which will not produce cracks at high temperatures to about 500° C. cannot be obtained.

According to the present invention, Mg may be added at an amount of about 0.05 to about 6 weight % in addition to Mn. This addition of Mg accelerates crystallization of the Al—Mn intermetallic compound. Below 0.05 weight %, the effect of acceleration of crystallization is not achieved whereas beyond about 6 weight %, the alloy base material deteriorates in castability and ductility.

The aluminum alloy base material may contain other elements within the ranges mentioned below without producing any substantial change in the characteristic of the intermetallic compound produced: Fe<0.5 weight %, Si<2.0 weight %, 0.03 weight %<Cr<0.3 weight %, Zr<0.3 weight %, V<0.3 weight %, Ni<1 weight %, Cu<1 weight %, Zn<1 weight %, 0.03 weight %<Ti<0.15 weight %, B<1 to 100 ppm, and Be<0.05 weigh %.

Figure 1A:
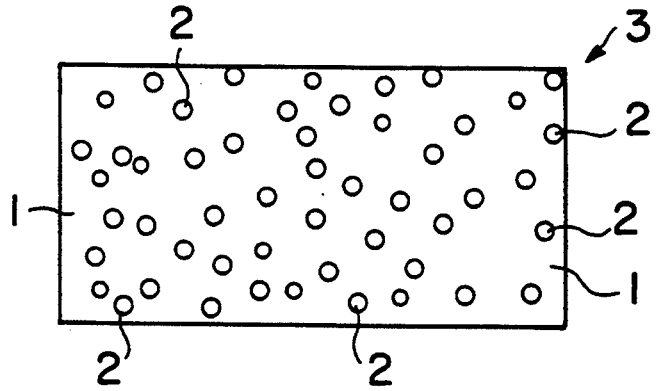
FIG. 1A is an illustration of an aluminum alloy base material having an intermetallic compound disbursed according to the present invention.

Then, the aluminum alloy material undergoes a heat treatment, which is performed by heating the aluminum alloy material at 300° to 600° C. for 0.5 to 24 hours. However, the aluminum alloy material may be heated for 48 hours, for example, and there is no particular upper limit of the heating time. This heat treatment causes particles 2 of the Al—Mn intermetallic compound to be dispersed in the aluminum alloy base material 1 as illustrated in FIG. 1A.

In the precipitates of the Al—Mn intermetallic compounds $Al_6$ Mn is contained as main component, and $Al_6$ (MnFe), αAlMn(Fe)Si and a solid solution of each of these compounds with a trace amount of Cr, Ti, etc. The size and density of these Al—Mn precipitates give considerable influences to an anodic oxide film produced in heat resistance and emissivity. To produce an infrared radiation element with excellent characteristics, it is preferable to provide the precipitates for a size of 0.01 to 3 μm and a density larger than $1\times10^5/mm^3$. The size of the precipitates refers to the diameter of a sphere having the same volume as the precipitates. It is preferable as an infrared radiation element to have as large a density as possible.

The aluminum alloy base material with a composition according to the present invention may be used without applying any working on it, (that is, casting or ingot) but may be subjected to plastic working such as rolling and extrusion. It is however necessary to place intermetallic compounds in a crystallized state previously mentioned and to make the base material into a desired shape.

Figure 1B:
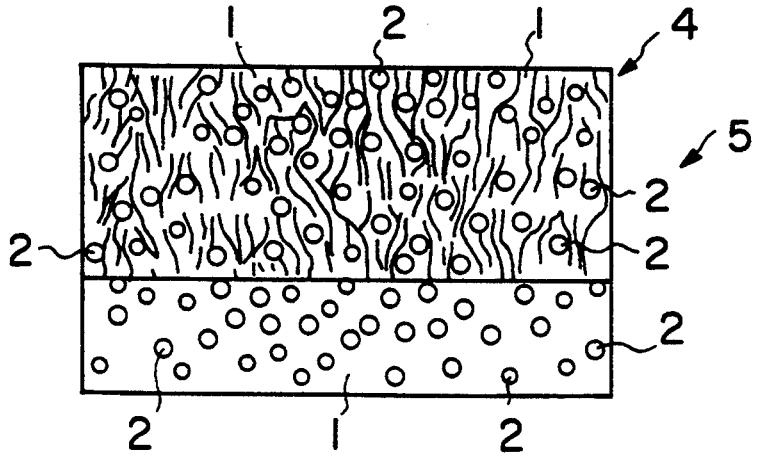
FIG. 1B is an illustration of an infrared radiation element, in section, which was, according to the present invention, produced by forming an anodic oxide film on the aluminum alloy base material of FIG. 1A.
Figure 2:
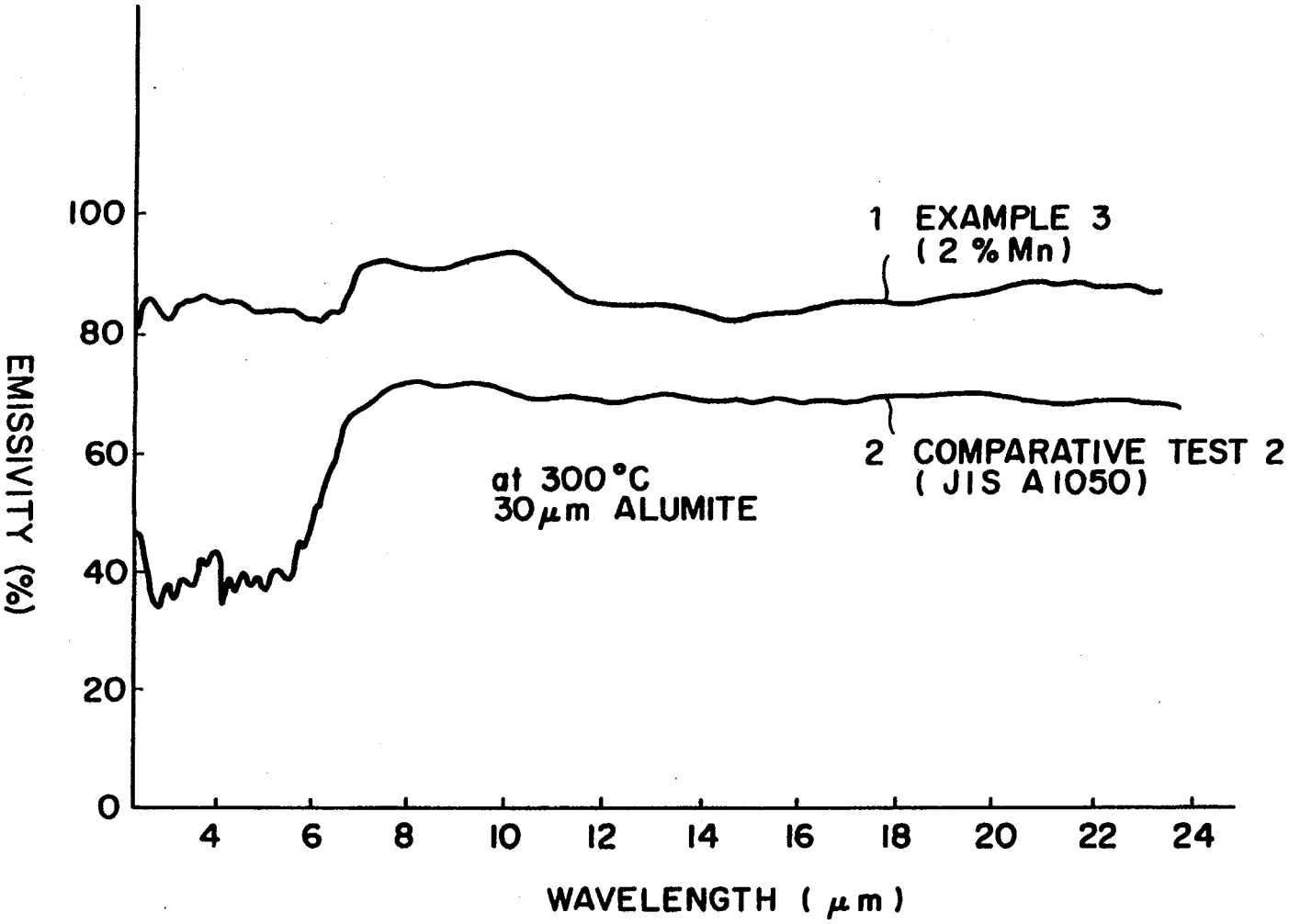
FIG. 2 is a graph showing the results of measurement of infrared ray spectral emissivity of infrared radiation elements of the present invention and comparative tests.

Then, according to the present invention the aluminum alloy material having particles 2 of the intermetallic compounds dispersed is anodized in a sulfuric acid bath, so that as shown in FIG. 1B an infrared radiation element with an anodic oxide film 4 formed on the surface thereof is produced.

During this anodization treatment, the anodic oxide film 4 grows with the intermetallic compound particles 2 remained in the state dispersed in the aluminum alloy material 3. Although conventionally micropores are linearly formed in the anodic oxide film, according to the present invention micropores are, as illustrated in FIG. 1B, branched. This is because micropores grow so as to avoid crystallized particles of Al—Mn intermetallic compounds as the anodic oxide film is formed.

The anodic oxide film 4 has a non-uniformly branched porous structure, and cracks which would be produced in conventional anodic oxide films cannot be visually observed In the film 4 even if it is heated up to about 500° C. This is considered that stresses caused by difference in thermal expansion are absorbed due to the unevenly branched micropore structure. Thus, the black anodic oxide film 4 of the present invention does not change in color and produces little cracks against high temperature heating up to about 500° C., and the infrared radiation element according to the present invention can be used as a stable element for a relatively long period of time at high temperatures. The infrared radiation element with the anodic oxide film according to the present invention has achieved an improvement of about 300° C. in heat resistance as compared to conventional infrared radiation element with anodic oxide films which produces cracks above about 200° C.

The black appearance of the anodic oxide film of the infrared radiation element of the present invention provides an excellent infrared radiation characteristic also in a wavelength region of 3 to 7 μm as compared to conventional anodic oxide films.

Preferably, the anodic oxide film 4 has a thickness at least 1O μm. In the case when the anodic oxide film 4 is thinner than 10 μm, the infrared radiation element drops in infrared radiation characteristic and in capacity of absorbing thermal strains in the anodic oxide film, resulting in that cracks are likely to be produced even below 200° C. With a thickness at least 10 μm, the anodic oxide film 4 exhibits a Munsell value 4.5 at a maximum, the Munsell value showing brightness of the surface thereof. Furthermore, there is little possibility of producing cracks by heating to 500° C., and of changing in black color. Thus, the infrared radiation element according to the present invention is provided with a stable infrared radiation characteristic in a wide range of wavelength.

How to form the anodic oxide film 4 is not particularly limited although the film must be porous. Electrolytic baths using an inorganic acid, organic acid or a mixture of these acids, such as a sulfuric acid and oxalic acid, may be adopted. The anodic oxide treatment may be according to the present invention made using d.c. current, a.c. current. These currents may be used at the same time. From the points of economy and operability, a sulfuric acid bath and a d.c. current are preferably used.

In the case of a sulfuric acid, the anodizing treatment is carried out by the use of 1 to 35 wt. %, preferably 10 to 30 wt. %, of sulfuric acid under the conditions of a bath temperature of −10° to 35° C., preferably 5° to 30° C., and a current density of 0.1 to 10 A/dm$^2$, preferably 0.5 to 5 A/dm$^2$.

The base material of the present invention has a degree of working larger than that of base materials of the conventional infrared radiation elements since the aluminum alloy of the present invention is excellent in ductility. Furthermore, even after the anodic oxide film is formed, the infrared radiation element of the present invention is excellent in workability as compared to conventional infrared radiation elements, end hence the anodized infrared radiation element of the present invention may undergo a relatively small degree of working.

As previously described, in the anodic oxide film of the present invention, black alumina is stabley present which has a preferable heat resistance as an infrared radiation element (the anodic oxide film 3 is presumed alumina), and is hence excellent in spectral emissivity capacity.

In the case where the aluminum alloy base material is a casting, an ingot or a like material, after a cutting treatment it may be subjected to anodizing without deteriorating the capacity of infrared radiation. Various kinds of working, such as drawing, bending or like processing, may be conducted to the base material of the present invention.

The specific composition of the aluminum alloy according to the present invention will be described hereinafter. The aluminum alloy material according to the present invention preferably contains 0.8 to 1.5 wt. % of Mn. Below 0.8 wt. % it is not possible to sufficiently black the anodic oxide film. Beyond 1.5 wt. % of Mn coarse intermetallic compounds are produced as primary crystallization during casting, particularly usual direct casing (semi-continuous casting), and such a concentration is not preferably.

Mg is not indispensable element for the aluminum alloy material of the present invention. However, Mg accelerates crystallization of Al—Mn intermetallic compounds, and contributes the production of the crystallized state previously stated. Particularly, at a range of a relatively small amount of Mn, it is considerably effective to increase the amount of addition of Mg for more positively blacking the anodic oxide film as well as accelerating the crystallization of Al—Mn intermetallic compounds although casting becomes harder. Beyond 2.0 weight % of Mg, it is possible to black the anodic oxide film but sheet continuous casting becomes harder, resulting in degradation in utility. Thus, the aluminum alloy material of the present invention preferably contains not more than 2.0 weight % of Now, the conditions of producing the aluminum alloy material according to the present invention will be described. As previously described, the casting speed and the heating temperature to crystallize the alloy are importance for achieving the appropriate crystallization state of Al—Mn intermetallic compounds as well as appropriate black tone of the alloy after the anodic oxidizing treatment.

Regarding a cooling speed of the alloy of the present invention, it is possible to crystallize Al—Mn intermetallic compounds in an appropriate crystallized state by producing a sufficient solid solution which is produced by raising the casting speed. For this purpose, a cooling speed of at least 5° C./sec is preferable. Particularly, in the case of producing a large-sized sheet, sheet continuous casting (continuous casting rolling) which directly produces 5 to 10 mm thick sheets may be applied to attain a cooling speed of at least 5° C./sec. The upper limit of the cooling speed according to the present invention is a speed at which a sufficient solid solution of Mn is produced in the surface portion of the alloy, and which produce an appropriate amount of precipitate of intermetellic compounds in the subsequent heat treatment.

The heating for the crystallization of intermetallic compounds should be carried out at 300° to 600° C. for at least 0.5 hour. The heating may be conducted for 48 hours, for example, and the upper limit is determined in view of economy. Below 300° C., the precipitates becomes too small to obtain a black anodic oxide film excellent in infrared radiation characteristic by anodic oxidization. On the other hand, beyond 600° C. the anodic oxide film become considerably light in color end crystal grains of the alloy become rather coarse. The heating is sufficient if the aluminum alloy is kept at 300° C. at a minimum for at least 0.5 hour. If the heating at a minimum temperature of 300° C. is shorter than 0.5 hour, sufficient black anodic oxide film cannot be obtained after anodization.

EXAMPLE 1

Aluminum alloy plates 1 in thick which contained 0.3 wt. %, 2.0 wt. %, 2.5 wt. %, and 4.3 wt. % of Mn, respectively, were fabricated. The aluminum alloy plates were heated at 400° C. for 12 hours to produce aluminum alloy plates having Al—Mn intermetallic compounds uniformly dispersed in them. According to transmission electron microscope observation, precipitates were $3\times10^5/mm^3$ to $1\times10''/mm^3$ in density for a size of 0.01 to 3 μm. Some of the aluminum alloy plates containing 5 wt. % of Mn were broken during rolling.

Subsequently, the aluminum alloy plates was anodized in a 25 wt. % sulfuric acid bath at 7° C. to thereby produce 5, 10, 15, 20, 30, 40 and 50 μm thick anodic oxide films on them, respectively.

Then, these alloy plates were set in a spectroemissivity measuring equipment, in which they were measured. In infrared radiation emissivity in a wavelength of 6 μm at 80° and 300° C. The results are given in Table 1A.

Thereafter, the aluminum alloy plates were respectively heated at 200°, 250°, 300°, 400° and 500° C. for one hour, and after heating, it was observed as to whether or not cracks had been produced. Although it was observed in 0.3% Mn aluminum alloy plates that slight cracks were produced in the anodic oxide films when the anodic oxide films were relatively thick (50 μm), no clacks were visually observed in the other aluminum alloy plates at specified temperatures. In Table IB, only results after heating at 200° C. for one hour are given.

Comparative Test 1

(1) Aluminum alloy plates 1 mm thick which contained 0.9 wt. %, and 5.0 wt. % of Mn, respectively, were heated and anodized in the same conditions as in Example 1. According to transmission electron microscope observation after heating, for the aluminum alloy plates containing 0.1 wt. % of Mn, precipitates were $2\times10_4/mm_3$in density for size of 0.02 to 0.8 μm and whereas for the 5.0 wt. % Mn aluminum alloy plates, precipitates were $3\times10^5/mm^3$ to $1\times10''/mm^3$ in density for a size of 0.01 to 3 μm. Some of the aluminum alloy plates containing 5.0 wt. % of Mn were broken during rolling.

Subsequently, as in Example 1 the aluminum alloy plates were anodized in a 25 wt. % sulfuric acid bath at 7° C. to thereby produce 5, 10, 15, 20, 30, 40 and 50 μm thick anodic oxide films on them, respectively.

Then, these alloy plates were tested in the same manner as in Example 1, and the results are given in Tables 1A and IB.

(2) Aluminum plates 1 mm thick of JIS (Japanese Industrial Standards) A1050 (pure aluminum) were anodized in a 25 wt. % sulfuric acid bath at 7° C. to thereby produce 5, 10, 15, 20, 30, 40 and 50 μm thick anodic oxide films on them, respectively.

Then, as in Example 1 these specimens were measured in infrared radiation emissivity in a wavelength of 6 μm at 80° and 300° C. by the spectroemissivity measuring equipment. The results are given in Table 1A.

Thereafter, the plates were respectively heated at 200°, 250°, 300°, 400° and 500° C. for one hour, and after heating, it was visually inspected as to whether or not cracks had been produced. As a result, it was confirmed that cracks were produced in the anodic oxide films of all the specimens except the 5 μm anodic oxide films. As in Example 1, only results of the specimens heated at 200° C. are given in Table 1.

From Table 1A, it is clear that the JIS Al050 specimens deteriorated in emissivity at 300° C. although they were acceptable at 80° C. On the other hand, specimens which fell within the scope of the present invention exhibited excellent emissivity at both 80° and 300° C. It was noted that 0.3% Mn specimens had been slightly degraded in emissivity as compared to 2.0–4.3% Mn specimens.

Regarding pure aluminum plates of Comparative Test 1, the 200° C.×1 hour heating test revealed that cracks were visually observed in anodic oxide layers of all the specimens except 5 μm anodic oxide specimens. In specimens containing 0.3 to 4.3% by weight of Mn according to the present invention, no cracks were visually observed except that 0.3% Mn specimens which had 50 μm anodic oxide layer had slight cracks produced.

TABLE 1A

| Concentration of Mn (wt. %) | Temp. (°C.) | Emissivity (wavelength: 6 μm) Thickness of Anodic oxide (μm) | | | | | | |
|---|---|---|---|---|---|---|---|---|
| | | 5 | 10 | 15 | 20 | 30 | 40 | 50 |
| Example 1 | | | | | | | | |
| 0.3 | 80 | 0.62 | 0.65 | 0.80 | 0.70 | 0.72 | 0.72 | 0.75 |
| 0.3 | 300 | 0.63 | 0.65 | 0.65 | 0.68 | 0.70 | 0.70 | 0.73 |
| 2.0 | 80 | 0.65 | 0.72 | 0.75 | 0.75 | 0.78 | 0.80 | 0.85 |
| 2.0 | 300 | 0.65 | 0.75 | 0.75 | 0.80 | 0.82 | 0.83 | 0.85 |
| 2.5 | 80 | 0.68 | 0.73 | 0.75 | 0.75 | 0.78 | 0.80 | 0.85 |
| 2.5 | 300 | 0.68 | 0.75 | 0.77 | 0.77 | 0.82 | 0.82 | 0.85 |
| 4.3 | 80 | 0.66 | 0.68 | 0.70 | 0.72 | 0.72 | 0.73 | 0.72 |
| 4.3 | 300 | 0.65 | 0.63 | 0.70 | 0.72 | 0.72 | 0.73 | 0.73 |
| Comparative Test 1 | | | | | | | | |
| 0.1 | 80 | 0.58 | 0.60 | 0.61 | 0.62 | 0.65 | 0.65 | 0.67 |
| 0.1 | 300 | 0.48 | 0.50 | 0.52 | 0.53 | 0.57 | 0.60 | 0.62 |
| 5.0 | 80 | 0.60 | 0.62 | 0.62 | 0.64 | 0.67 | 0.69 | 0.72 |
| 5.0 | 300 | 0.55 | 0.57 | 0.58 | 0.60 | 0.61 | 0.63 | 0.65 |
| JIS A 1050 | 80 | 0.45 | 0.51 | 0.53 | 0.55 | 0.56 | 0.61 | 0.65 |
| JIS A 1050 | 300 | 0.25 | 0.29 | 0.36 | 0.42 | 0.48 | 0.52 | 0.58 |

TABLE 1B

| Concentration of Mn (wt. %) | Cracks after heating at 200° C. Thickness of Anodic oxide (μm) 5 | 10 | 15 | 20 | 30 | 40 | 50 | Cracks*1 (nonheated) | Workability*2 |
|---|---|---|---|---|---|---|---|---|---|
| Example 1 | | | | | | | | | |
| 0.3 | o | o | o | o | o | o | □ | □ | o |
| 2.0 | o | o | o | o | o | o | o | o | o |
| 2.5 | o | o | o | o | o | o | o | o | o |
| 4.3 | o | o | o | o | o | o | o | □ | □ |
| Comparative Test 1 | | | | | | | | | |
| 0.1 | o | □ | x | x | x | x | □ | o | |
| 5.0 | o | o | o | o | o | □ | x | x | |
| JIS A 1050 | x | x | x | x | x | x | x | o | |

o: No crack confirmed.
□: Slight cracks confirmed in specimens.
x: Unacceptable cracks confirmed.
*1: Specimens with 30 μm anodic oxide layer which did not undergo the heating treatment. It was treated whether or not cracks were produced when the specimens were bent to have a diameter 50 times as large as the thickness thereof.
*2: Workability of the base material, that is, the plates without no anodic oxide layer.

EXAMPLE 2

0.6 mm thick aluminum alloy plates containing 2.0 weight % of Mn and 1.0 weight % of Mg were heated at 400° C. for 5 hours, and were then drawn at a ratio of 1.9 into a cup shape. These cups were anodized to form a 30 μm thick anodic oxide layer.

The infrared radiation characteristic at 80° and 300° C. of each of the anodized specimens was determined, and it was confirmed that the cup-shaped specimens were the same in emissivity as plate-like specimens of Example 1, and that they were excellent in drawability.

EXAMPLE 3

Aluminum alloy plates containing 2.0 weight % of Mn and JIS Al050 aluminum plates were used, and each of the specimens was provided with a 30 μm anodic oxide layer in the same forming conditions. Then, measurement of spectral emissivity at 300° C. from 3 to 24 μm was made about these specimens by a Fourier transform infrared spectrophotometer sold by Nippon Baioraddo Raboratori, Japan under a tradename "FTS-7 system", and the results are given in FIG. 3.

From FIG. 3, it is clear that the specimens according to the present invention were excellent in emissivity in the region of a wavelength 4 to 24 μm. Particularly in a short wavelength region of 4 to 8 μm, the specimens according to the present invention were relatively small in drop of emissivity and excellent in characteristic.

EXAMPLE 4

A billet having 60 mm diameter was produced by continuous casting, the billet including 2 wt. % of Mn, 0.5 wt. % of Mg, 0.10 wt. % of Fe, 0.08 wt. % of Si, and balance Al. The billet was heated at 500° C. for 5 hour, and was then extruded into a 3 mm thick channel-shaped specimen.

After extruded, the specimen was observed by a transmission electron microscope and it was confirmed that precipitates for a size 0.01 to 3 μm were dispersed at a density of $1\times10^6$ to $1\times10^{11}/mm^3$.

As in Example 1, an 30 μm thick anodic oxide phase was formed on the specimen. The specimen exhibited an excellent far infrared characteristic: 0.82 and 0.85 in spectral emissivity at a wavelength of 6 μm at 80° and 300° C., respectively.

EXAMPLE 5

An aluminum alloy material including 2.5 wt. % of Mn, 0.25 wt. % of Fe, 0.08 wt. % of Si, and balance Al saw die cast. The material was heated at 450° C. for 5 hours, and then a disk 5 mm thick and 30 mm in diameter was cut from the material. The disk was observed by a transmission electron microscope and it was confirmed that precipitates for a size 0.01 to 3 μm were dispersed at a density of $1\times10^9$ to $1\times10^{11}/mm^3$.

As in Example 1, an 30 μm thick anodic oxide phase was formed on the disk. The specimen exhibited an excellent far infrared characteristic: 0.82 and 0.84 in spectral emissivity at a wavelength of 6 μm at 80° and 300° C., respectively. It was confirmed that according to the present invention even casting was excellent in far infrared characteristic.

EXAMPLE 6 COMPARATIVE TEST 2

Alloys indicated by alloy Nos. 1 and 2 in Table 2 were cast into 7 mm thick plates by sheet continuous casting machine with a cooling speed of 200° to 300° C./sec. These plates underwent cold rolling to reduce thickness thereof to 1.5 mm, and was then heated on the conditions shown in Table 3 for crystallization.

On the other hand, alloys Nos. 3 and 4 of Table 2 were die cast by a 50 mm thick book mold. In this case, the alloys were cooled at a speed of 0.5° to 1.0° C./sec. The cast plate obtained was sliced into 7 mm plates, which also underwent cold rolling to reduce thickness thereof to 1.5 mm. Then, the rolled plates were heated on conditions given in Table 2 for crystallization.

Each of the plates subjected to the crystallization treatment, was observed by a transmission electron microscope for determining the density of precipitates having a size of 0.01 to 3 μm. The results are given in Table 3.

After the crystallization treatment, each of the plates were etched in 10% NaOH aqueous solution, washed with water, and then death matted with a nitric acid. Thereafter, the plates were anodized in a sulfuric bath on the following conditions to thereby form a 30 μm anodic oxide film:

concentration of sulfuric acid: 15%
bath temperature: 20° C.
current density: 1.5 A/dm$^2$ The emissivity at 300° C. for 6 μm of each of the anodized plates was measured, and the results are given in Table 3. As shown in Table 3, alloys Nos. 1 and 2 which fell within the scope of the present invention and were subjected to the process according to the present invention exhibited excellent emissivities.

TABLE 2

| Alloy No | Composition (wt. % except B) Mn | Mg | Cr | Fe | Si | Ti | B (ppm) | Al | Casting |
|---|---|---|---|---|---|---|---|---|---|
| 1 | 2.0 | — | — | 0.21 | 0.10 | 0.01 | 3 | balance | *1 |
| 2 | 3.0 | 0.5 | 0.18 | 0.13 | 0.13 | 0.01 | 12 | balance | *1 |

TABLE 2-continued

| Alloy No | Composition (wt. % except B) Mn | Mg | Cr | Fe | Si | Ti | B (ppm) | Al | Casting |
|---|---|---|---|---|---|---|---|---|---|
| 3 | 1.9 | — | — | 0.23 | 0.12 | 0.01 | 5 | balance | *2 |
| 4 | 3.0 | 0.5 | 0.18 | 0.10 | 0.80 | 0.01 | 15 | balance | *2 |

*1: sheet continuous casting
*2: die casing

TABLE 3

| Alloy No. | Heating | Density of Precipitate for size 0.01-3 μm (/mm³) | Spectral emissivity |
|---|---|---|---|
| 1 | 350° C. × 2 hr | $5 \times 10^{11}$ | 0.87 |
| 2 | 350° C. × 2 hr | $5 \times 10^{12}$ | 0.91 |
| 3 | 350° C. × 2 hr | $5 \times 10^{7}$ | 0.73 |
| 4 | 350° C. × 2 hr | $8 \times 10^{7}$ | 0.76 |
| 5 | 550° C. × 2 hr | $1 \times 10^{6}$ | 0.71 |

What is claimed:

1. An infrared radiation element comprising:
an aluminum alloy material consisting essentially of 0.3 to 4.3 weight % of Mn, not more than 0.5 weight % of Fe, balance Al, and impurities; and
an anodic oxide layer formed on a surface of the aluminum alloy.

2. An infrared radiation element as recited in claim 1, wherein the aluminum alloy has a precipitate of an Al—Mn intermetallic compound dispersed at a density of $1 \times 10^5/mm^3$ at a minimum for a size of 0.01 μm to 3 μm.

3. An infrared radiation element as recited in claim 2, wherein the anodic oxide layer has a thickness at least 10 μm thick.

4. An infrared radiation element comprising:
an aluminum alloy consisting essentially of 0.3 to 4.3 weight % of Mn, 0.05 to 6 weight % of Mg, not more than 0.5 weight % of Fe, balance Al, and impurities; and
an anodic oxide layer formed on a surface of the aluminum alloy.

5. An infrared radiation element as recited in claim 4, wherein the aluminum alloy has a precipitate of an Al—Mn intermetallic compound dispersed at a density of $1 \times 10^5/mm^3$ at a minimum for a size of 0.01 μm to 3 μm.

6. An infrared radiation element as recited in claim 5, wherein the anodic oxide layer has a thickness at least 10 μm thick.

7. A process of producing an infrared radiation element, comprising the steps of:
(a) heating an aluminum alloy consisting essentially of 0.3 to 4.3 weight % of Mn, not more than 0.5 weight % of Fe, balance Al, and impurities for dispersing a precipitate of an Al—Mn intermetallic compound at a density of at a minimum $1 \times 10^5/mm^3$ for a size of 0.01 μm to 3 μm; and
(b) anodizing the heated aluminum alloy to form an anodic oxide layer thereon.

8. A process as recited in claim 7, wherein in the heating step (a) the aluminum alloy is heated at 300° to 600° C. for at least 0.5 hour.

9. A process as recited in claim 7, wherein in the anodizing step (b) the aluminum alloy is anodized in an 1 to 35 weight % of sulfuric acid as an electrolytic bath at −10° to 35° C. with a current density of 0.1 to 10 A/dm².

10. A process as recited in claim 9, wherein in the anodizing step (b) the aluminum alloy is anodized in an 10 to 30 weight % of sulfuric acid as an electrolytic bath at 5° to 30° C. with a current density of 0.5 to 5 A/dm².

11. A process of producing an infrared radiation element, comprising the steps of:
(a) heating an aluminum alloy consisting essentially of 0.3 to 4.3 weight % of Mn, 0.05 to 6 weight % of Mg, not more than 0.5 weight % of Fe, balance Al, and impurities for dispersing a precipitate of an Al—Mn intermetallic compound at a density of at a minimum $1 \times 10^5/mm^3$ for a size of 0.01 μm to 3 μm; and
(b) anodizing the heated aluminum alloy to form an anodic oxide layer thereon.

12. A process as recited in claim 11, wherein in the heating step (a) the aluminum alloy is heated at 300° to 600° C. for at least 0.5 hour.

13. A process as recited in claim 11, wherein in the anodizing step (b) the aluminum, alloy is anodized in an 1 to 35 weight % of sulfuric acid as an electrolytic bath at −10° to 350° C. with a current density of 0.1 to 10 A/dm².

14. A process as recited in claim 13, wherein in the anodizing step (b) the aluminum alloy is anodized in an 10 to 30 weight % of sulfuric acid as an electrolytic bath at 5° to 30° C. with a current density 0.5 to 5A/dm².

15. A process of producing an infrared radiation element, comprising the steps of:
casting a molten alloy at a cooling speed of at least 5° C./sec to produce an aluminum alloy, the molten alloy consisting essentially of: 0.8 to 3.5 weight % of Mn; not more than 0.5 weight % of Fe, balance Al; and impurities;
heating the aluminum alloy at 300° to 600° C. for at least 0.5 hour for dispersing a precipitate of an Al—Mn intermetallic compound at a density of at a minimum $1 \times 10^5/mm^3$ for a size of 0.01 μm to 3 μm; and
anodizing the heated aluminum alloy to form an anodic oxide layer thereon.

16. A process of producing an infrared radiation element, comprising the steps of:
casting a molten alloy at a cooling speed at least 5° C./sec to produce an aluminum alloy, the molten alloy consisting essentially of: 0.8 to 3.5 weight % of Mn; 0.05 to 2.0 weight % of Mg; not more than 0.5 weight % of Fe, balance Al; and impurities;
heating the aluminum alloy at 300° to 600° C. for at least 0.5 hour for dispersing a precipitate of an Al—Mn intermetallic compound at a density of at a minimum $1 \times 10^5/mm^3$ for a size of 0.01 μm to 3 μm; and
anodizing the heated aluminum alloy to form an anodic oxide layer thereon.

17. A process of producing an infrared radiation element, comprising the steps of:

casting a molten alloy at a cooling speed of 0.5 to 20° C./sec to produce an aluminum alloy, the molten alloy consisting essentially of: 0.8 to 1.5 weight % of Mn; 2.0 to 4.5 weight % of Mg; not more than 0.5 weight % of Fe, balance Al; and impurities;

heating the aluminum alloy material at 300° to 600° C. for at least 0.5 hour for dispersing a precipitate of an Al—Mn intermetallic compound at a density of $1\times10^5/mm^3$ at a minimum for a size of 0.01 μm to 3 μm; and forming an anodic oxide layer on the heated aluminum alloy.

* * * * *